US006375041B1

(12) United States Patent
Klima et al.

(10) Patent No.: US 6,375,041 B1
(45) Date of Patent: Apr. 23, 2002

(54) RECHARGEABLE DISPENSING DEVICE

(75) Inventors: William L. Klima, Stafford, VA (US); Walter F. Klima, Jr., Travelers Rest, SC (US)

(73) Assignee: Sunpat L.L.C., Stafford, VA (US)

( * ) Notice: Subject to any disclaimer, the term of this patent is extended or adjusted under 35 U.S.C. 154(b) by 0 days.

(21) Appl. No.: 09/406,709

(22) Filed: Sep. 28, 1999

(51) Int. Cl.[7] ..... B67D 5/00

(52) U.S. Cl. ..... 222/129; 222/109; 222/571; 206/222; 215/6; 215/DIG. 8

(58) Field of Search ..... 222/81, 82, 83, 222/83.5, 80, 88, 129, 136, 566, 571–573, 109, 111; 141/329, 330; 206/219, 222; 215/6, DIG. 8

(56) References Cited

U.S. PATENT DOCUMENTS 4,088,246 A * 5/1978 Klingaman ..... 222/88
4,636,328 A * 1/1987 Flynn et al. ..... 215/6
5,114,011 A * 5/1992 Robbins, III ..... 206/219
5,131,566 A * 7/1992 Bavegems ..... 222/109
5,585,034 A * 12/1996 Lysy et al. ..... 510/403
5,700,331 A * 12/1997 Thomas et al. ..... 134/29
5,830,839 A * 11/1998 Scepanski ..... 510/305
5,836,479 A * 11/1998 Klima et al. ..... 222/83.5
6,006,388 A * 12/1999 Young ..... 222/83.5
6,162,259 A * 12/2000 Williams ..... 8/137

* cited by examiner

*Primary Examiner*—J. Casimer Jacyna
(74) *Attorney, Agent, or Firm*—William L. Klima

(57) ABSTRACT

The present invention is directed to a rechargeable dispenser including a cap removably connected to a bottle having an upwardly extending flange. The cap is provided with at least one reservoir to be compromised by the spout of the bottle to release chemical concentrate in the bottle for charging the rechargeable dispenser when mixed with a diluent such as water within the bottle.

21 Claims, 8 Drawing Sheets

FIG. 10
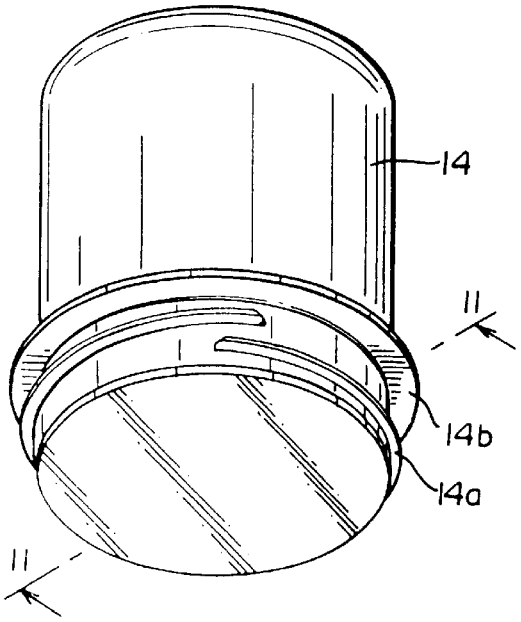
FIG. 12
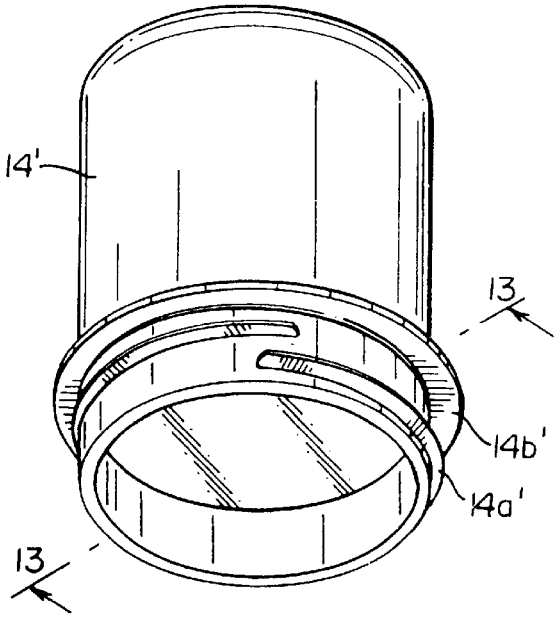
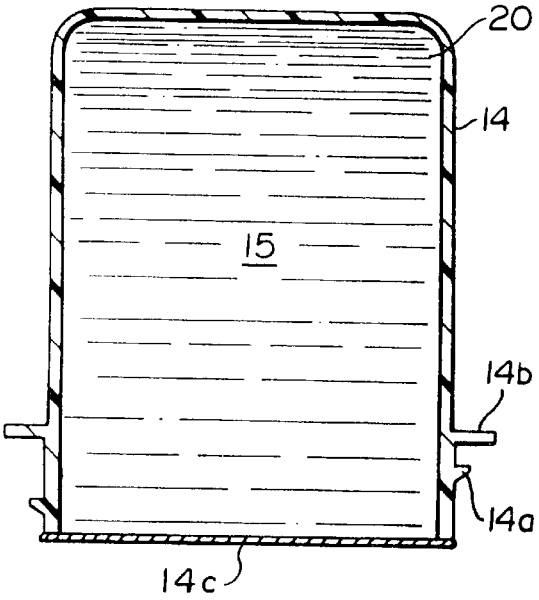
FIG. 11
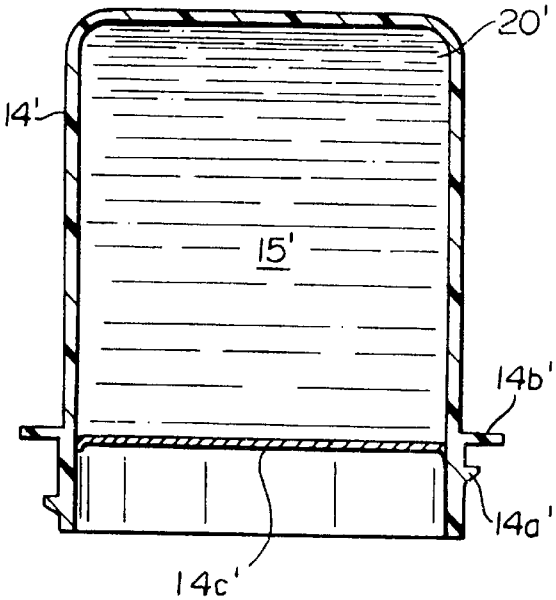
FIG. 13

FIG. 17
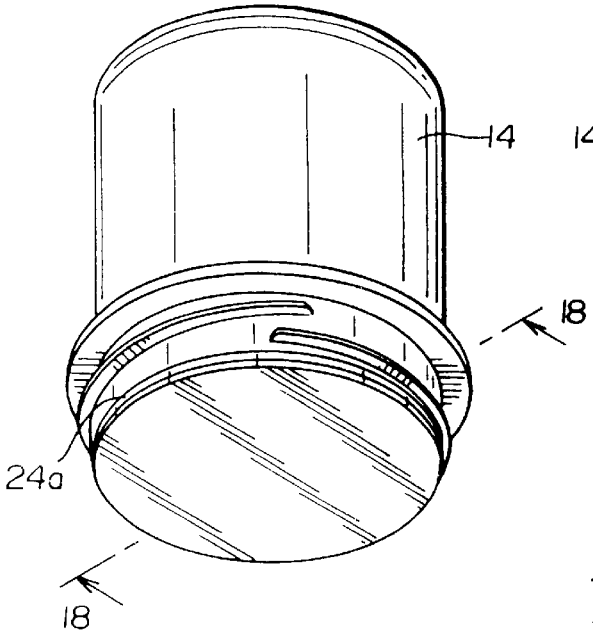
FIG. 19
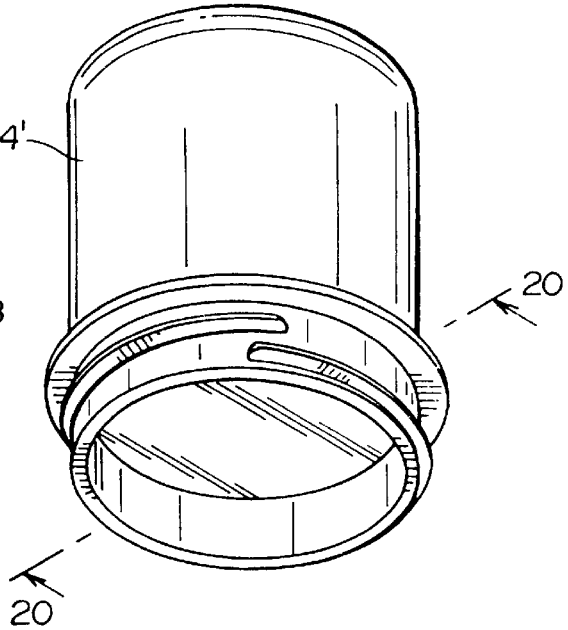
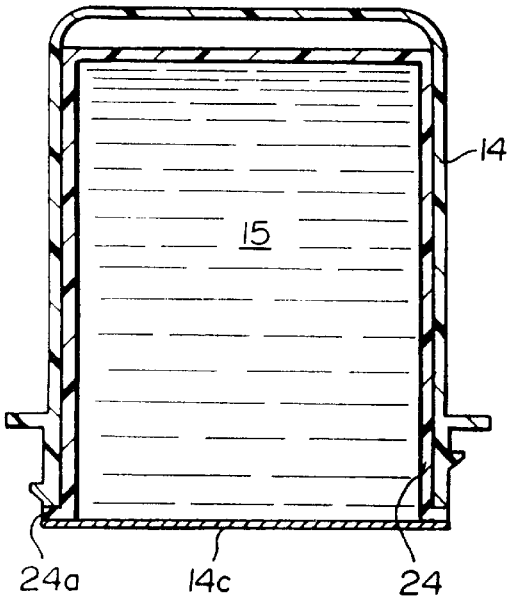
FIG. 18
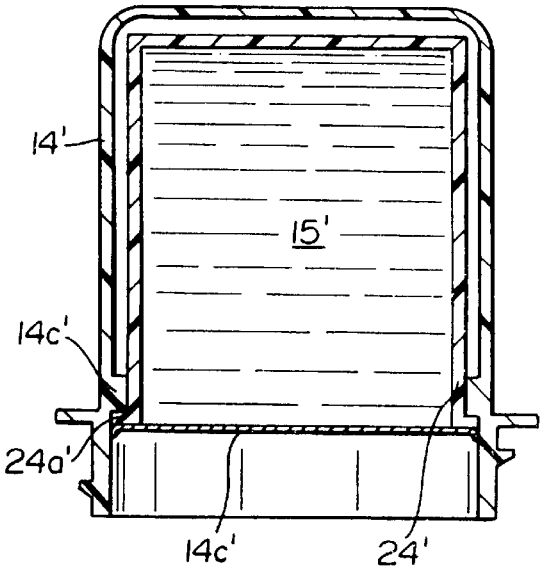
FIG. 20

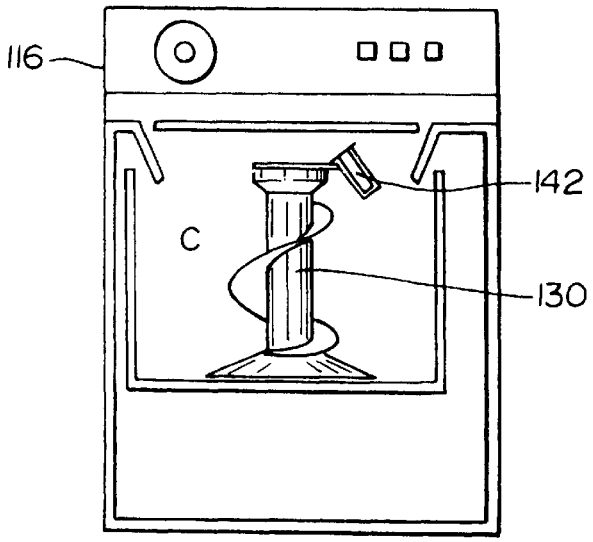
FIG. 23
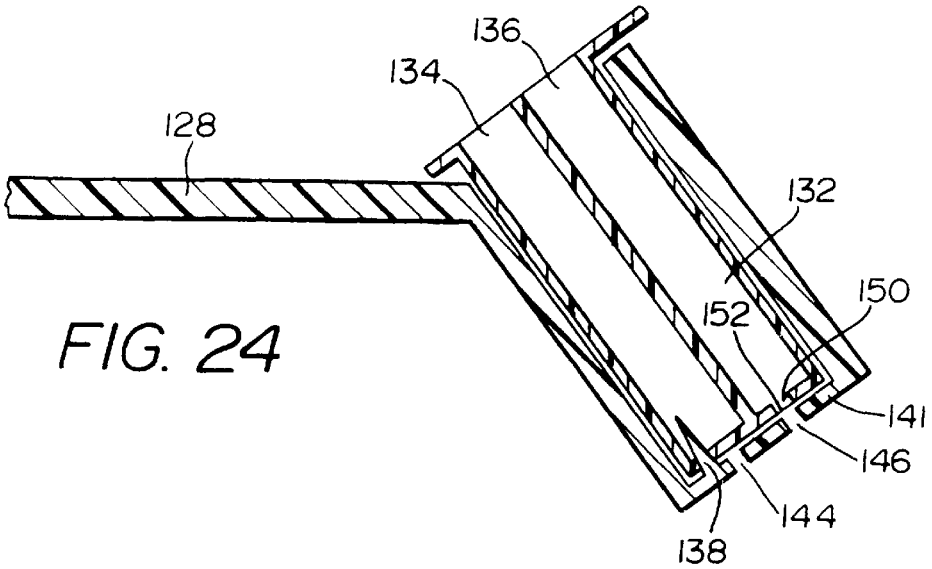
FIG. 24
FIG. 25
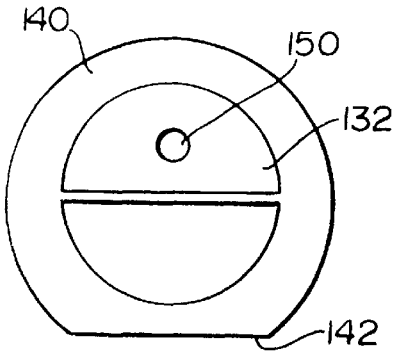
FIG. 26
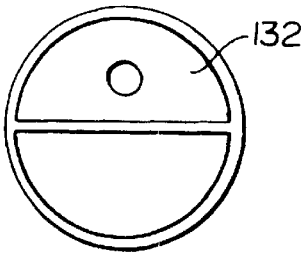

RECHARGEABLE DISPENSING DEVICE

BACKGROUND OF THE INVENTION

1. Field of the Invention

The present invention is directed to a rechargeable dispensing device. More specifically, the present invention is directed to a rechargeable dispensing device for use with a capsule or cartridge containing a concentrate to be mixed with a diluent within the rechargeable dispensing device.

2. Description of the Related Art

In both the consumer and commercial markets for cleaning products, most products are premixed and "ready-to-use" to provide convenience for the end user. However, most of these products contain a substantial percentage of water in their formulations. Thus, a large volume of space is required for storing and marketing such products. Further there is significant cost involved in shipping and transporting large quantities of high water based chemical products.

In the area of laundry detergents, large bottles (e.g. one gallon) containing liquid laundry detergent are readily sold to the consumer market today. In recent years, there has been a trend to more highly concentrated liquid laundry detergent to reduce the size of the container providing the same amount of product that was previously marketed in larger bottles with regards to active ingredients. However, even in these more concentrated liquid laundry detergents, there still exists a substantial percentage by weight of water.

There exists many other household cleaning products such as glass cleaners, all-purpose cleaners, sanitizers, disinfectants, liquid soap, bleach, fabric softener, fabric protectant, shower cleaning product (e.g. Clean Shower), deodorant, air freshener, carpet cleaner, that are all premixed and ready-to-use for sale on the shelves of supermarkets, drug stores, large chain stores (e.g. Walmart and K-Mart) and other smaller retailers that market and sell vast quantities of these premixed ready-to-use products.

The commercial and consumer products industries are all moving towards concentrated products, however, these products are inconvenient to use for the following reasons. Persons are unwilling to mix products when the amount of chemical to be added to the water is not pre-measured. Persons are unsure as to exactly how much liquid chemical product to use in mixing, and thus are apprehensive in making such judgements. Further, pouring from one container to another container can result in spills and a mess requiring cleanup by a person attempting to work with liquid concentrated products. Thus, there is a substantial need to bring convenience to the use of liquid chemical products.

SUMMARY OF THE INVENTION

An object of the present invention is to provide an improved rechargeable dispensing device.

A second object of the present invention is to provide a rechargeable dispensing device for use with a capsule or cartridge containing a concentrated product to be diluted within the rechargeable dispensing device with a diluent.

A third object of the present invention is to provide a rechargeable dispensing device including a container and closure, the closure configured for containing a concentrate.

A fourth object of the present invention is to provide a rechargeable dispensing device including a container and closure, the closure configured to contain concentrate and open when connected to the container.

A fifth object of the present invention is to provide a rechargeable dispensing device including a container and closure, the closure configured for containing a concentrate and storing the concentrate when the closure is connected to the container, and including a mechanism for subsequently opening the closure to release the chemical concentrate into the container.

A sixth object of the present invention is to provide a rechargeable dispensing device including a container and closure, the closure being provided with multiple chambers which can be selectively opened to allow for recharging of the container a multiple number of times.

A seventh object of the present invention is to provide a rechargeable dispensing apparatus which does away with the need for detergent bottles.

An eighth object of the present invention is to provide a rechargeable dispensing apparatus including a detergent tank in fluid communication with a wash bin of a washing machine and configured to selectively release detergent into said wash bin, and, a cartridge containing a chemically concentrated detergent and configured to be releasably received by the detergent tank for dilution of the chemically concentrated detergent in the detergent tank.

A ninth object of the present invention is to provide a rechargeable dispensing apparatus which allows for at least one pre-measured amount of at least one chemical to be introduced directly to the wash bin of a washing machine.

A tenth object of the present invention is to provide a rechargeable dispensing apparatus including a cage in fluid communication with a wash bin of a washing machine and a cartridge including at least one chemical reservoir and configured to be releasably received by the cage for introduction of the chemical to the wash bin of the washing machine.

The present invention is directed to a rechargeable dispenser including a bottle and a removably connected cap. The opening of the bottle is provided with a spout to facilitate pouring of the chemical product from the bottle. The spout extends upwardly from the opening of the bottle, and is protected by the cap when the cap is assembled onto the bottle. The rechargeable dispenser according to the present invention includes a reservoir for containing chemical concentrate or containing chemical concentrate associated with the rechargeable dispenser. Specifically, the reservoir can be a separate stand alone item sold separately from the rechargeable dispenser, however, the reservoir is configured to connect with the rechargeable dispenser in some manner. The reservoir may be packaged with the rechargeable dispenser, may be connected on the outside of the rechargeable dispenser (e.g. tied, glued, mechanically fastened), and/or can be provided within the rechargeable dispenser. The reservoir is preferably provided within the rechargeable dispenser, for example, within the cap and/or bottle. A preferred embodiment provides one or more reservoirs in the cap. More preferably, the cap is configured in such a manner that the one or more reservoirs can be compromised by the spout of the bottle.

A preferred system includes providing a cap with a removable cartridge having at least one reservoir. The cartridge is configured to fit within the cap, and is preferably removable so that the cartridge can be replaced within the cap while allowing the cap to be reused many times. Preferably, the cartridge is rotatable within the cap to allow the use of a multiple chamber cartridge with a stationary spout. In this manner, the cartridge can rotate while the cap is being tightened or loosened on the bottle.

A preferred method of marketing the rechargeable dispenser would be to shrinkwrap or blister pack caps containing chemical concentrate for use with the rechargeable dispenser according to the present invention. A purchaser would go to the store and purchase a cap instead of, for example, a one gallon ready-to-use conventional dispenser to take home or to a business for use. The presentation thereby greatly increases the amount of product which may be stocked on the retail or commercial shelf due to the high concentration of the chemical concentrate and elimination of unneeded diluent such as water. Further, the amount of space and carrying weight are greatly reduced for transporting a cap home or to a business versus the conventional ready-to-use product dispenser. Further, at the home or business, shelf space needed to store chemical products is greatly reduced again due to the high level of chemical concentration within the caps.

BRIEF DESCRIPTION OF THE DRAWINGS

FIG. 10 is a perspective view of a cap for use with the rechargeable dispenser according to the present invention.

FIG. 11 is a vertical center cross-sectional view of the cap shown in FIG. 10.

FIG. 12 is a perspective view of another embodiment of a cap for use with the rechargeable dispenser according to the present invention.

FIG. 13 is a vertical center cross-sectional view of the cap shown in FIG. 12.

FIG. 17 shows a perspective view of a cap for use with the rechargeable dispenser according to the present invention provided with a removable cartridge.

FIG. 18 is a vertical center cross-sectional view of the cap and cartridge system shown in FIG. 17.

FIG. 19 is a perspective view of an alternative embodiment of the cap and cartridge system shown in FIGS. 17 and 18.

FIG. 20 is a vertical center cross-sectional view of the cap and cartridge system shown in FIG. 19.

FIG. 23 shows a partial cross-sectional view of a washing machine including an alternative embodiment of a rechargeable dispensing apparatus according to the present invention.

FIG. 24 shows a partial cross-sectional view of a cage portion of the rechargeable dispensing apparatus shown in FIG. 23.

FIG. 25 shows a top planar view of the cartridge used in the cage portion of the rechargeable dispensing apparatus shown in FIGS. 24 and 25.

FIG. 26 shows a bottom view of the cartridge used in the cage portion of the rechargeable dispensing apparatus shown in FIGS. 24 and 25.

DETAILED DESCRIPTION OF PREFERRED EMBODIMENTS

Figure 1:
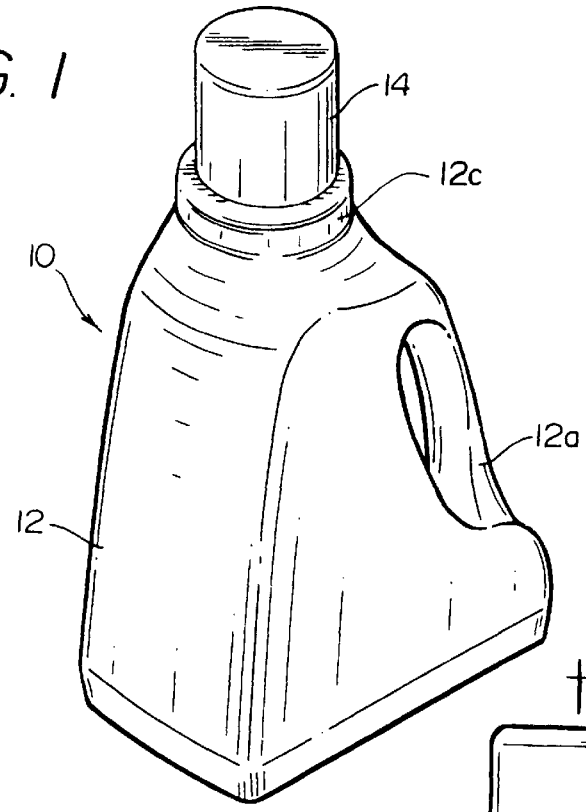
FIG. 1 is a perspective view of a rechargeable dispenser according to the present invention.
Figure 2:
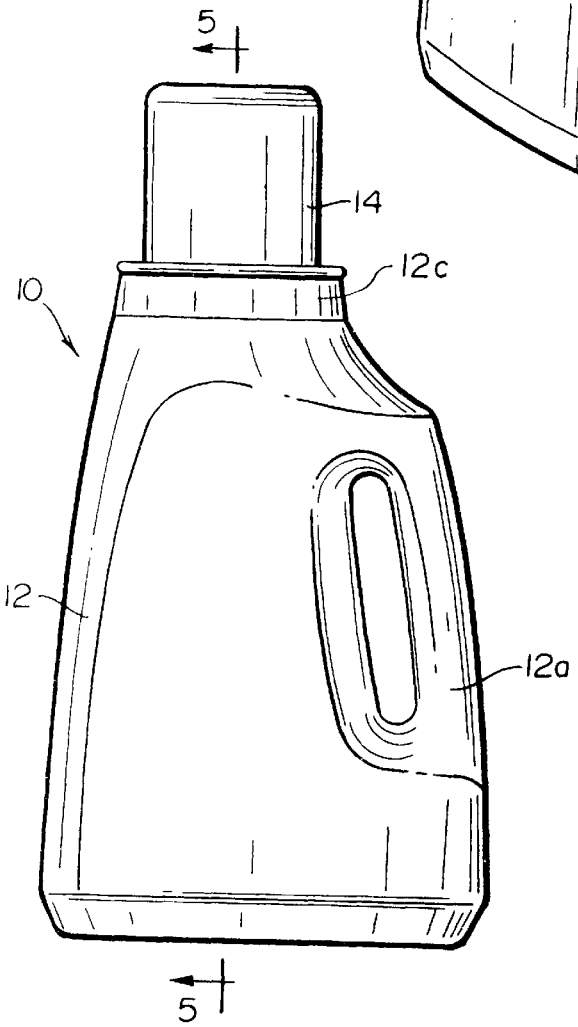
FIG. 2 is a side elevational view of the rechargeable dispenser shown in FIG. 1.
Figure 3:
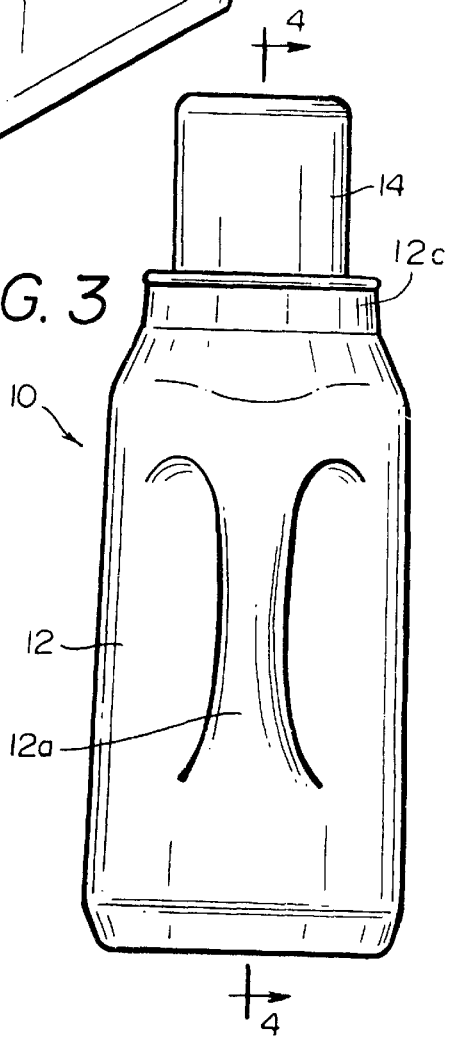
FIG. 3 is an end elevational view of the rechargeable dispenser shown in FIGS. 1 and 2.

A rechargeable dispenser according to the present invention is shown in FIGS. 1–3. This particular embodiment of the rechargeable dispenser according to the present invention is particularly suitable for laundry detergents, fabric softeners, and other home care or professional care products.

The rechargeable dispenser 10 includes a bottle 12 having a neck portion 12*c* and a cap 14. The bottle 12, for example, may be blow molded from polyethylene, polypropylene, polyvinyl chloride, PETE, or other suitable plastic material. The cap 14 for example, may be injection molded from the same or similar material as the bottle 12. The bottle 12 is molded with a handle 12*a* to allow a person to easily carry, move, and pour the bottle.

Figure 5:
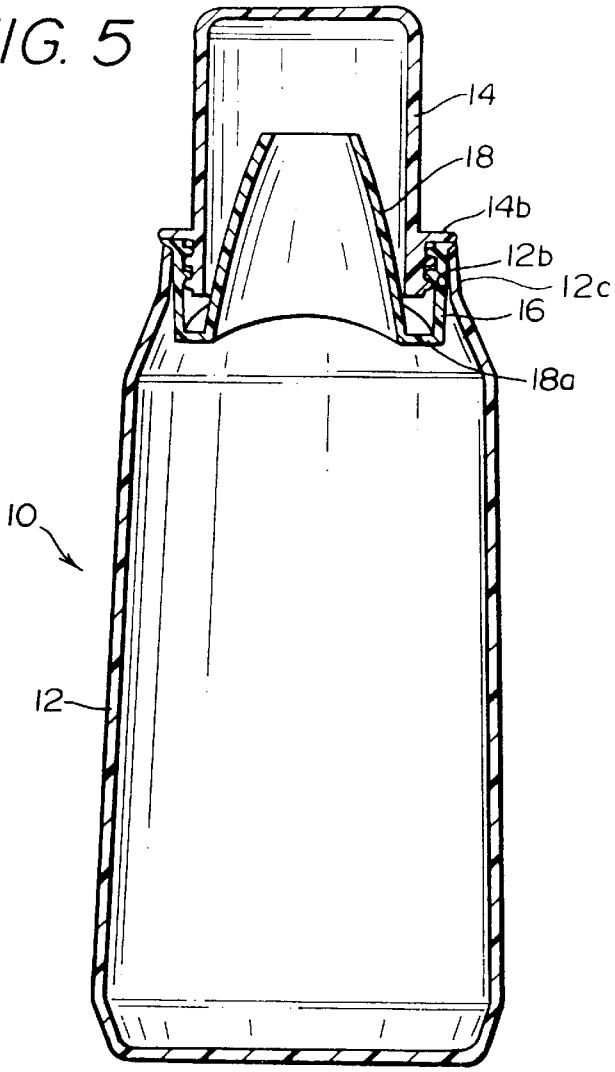
FIG. 5 is a vertical transverse cross-sectional view of the rechargeable dispenser as indicated in FIG. 2.
Figure 4:
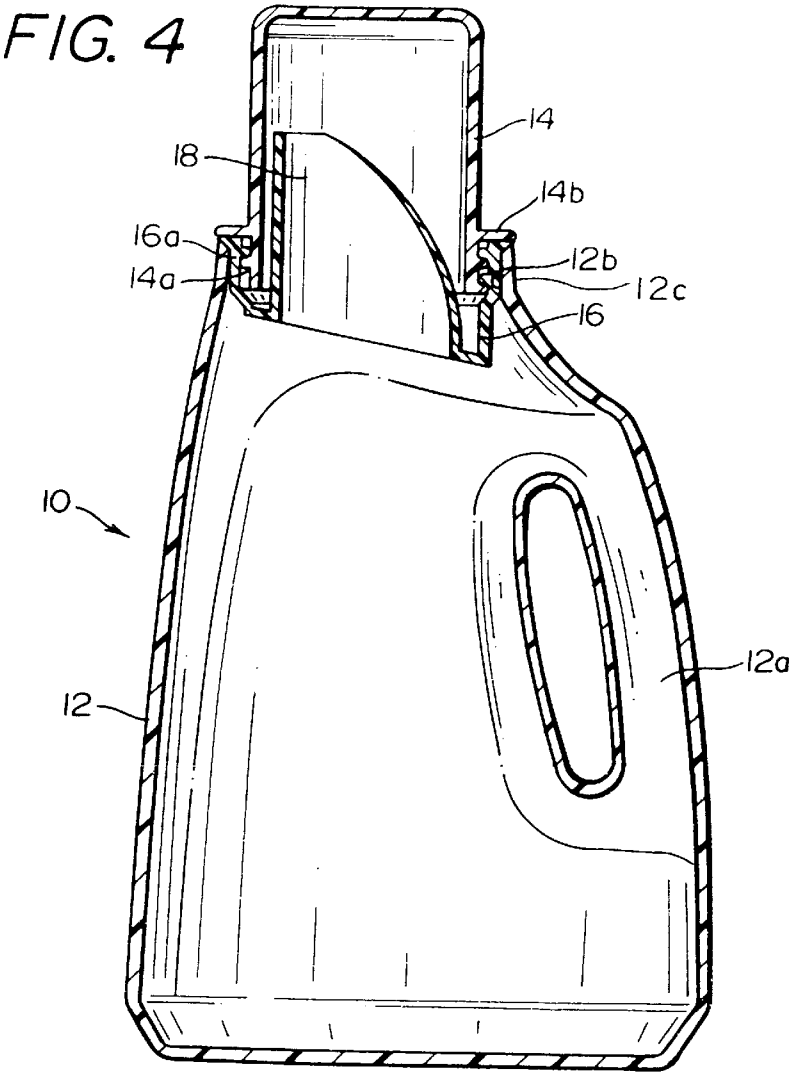
FIG. 4 is a vertical center side cross-sectional view of the rechargeable dispenser as indicated in FIG. 3.

As shown in FIGS. 4 and 5, the bottle 12 is provided with a separate neck opening 16 including a spout 18. The neck opening 16 fits into an open end 12*b* of the bottle 12. The neck opening 16 including spout 18 is shown as being one-piece construction, however, the neck opening 16 and spout 18 can be separate pieces assembled together.

The cap 14 is provided with external threads 14*a* cooperating with internal threads 16*a* of the neck opening insert 16. In the embodiment shown in FIGS. 4 and 5, the neck opening insert 16 is connected within the neck opening 12*b* of the bottle 12. The neck opening insert 16 is fixed to prevent rotation thereof within the neck opening 12*b* of the bottle 12. Thus, in this embodiment the spout 18 is also fixed from rotation relative to the bottle 12. Alternatively, the spout 18 can be configured to be a separate piece from the neck opening insert 16 to allow the spout 18 to freely rotate relative to the neck opening insert and bottle 12. In this alternative embodiment, the spout 18 can be moved into different positions for selectively opening one of a plurality of reservoirs to be provided in a cap. For example, viewing FIG. 5, the circular flange 18*a* of the spout 18 can be received within a circular channel provided at the base of the neck opening insert 16 to allow the spout 18 to move relative to the neck opening insert 16. In this alternative embodiment, the circular flange 18*a* may be oriented substantially horizontally to allow the circular flange to rotate within an inner channel provided in the base of the neck opening insert 16.

Figure 6:
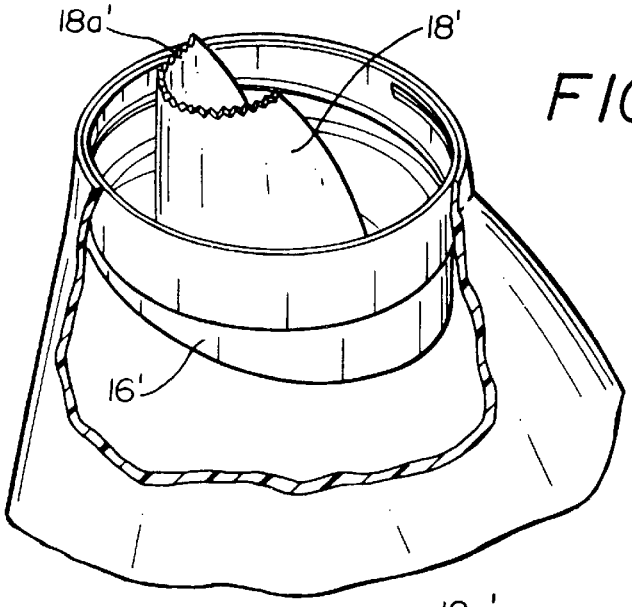
FIG. 6 is a partial broken away detailed perspective view of a bottle opening and spout of the rechargeable dispenser according to the present invention.
Figure 7:
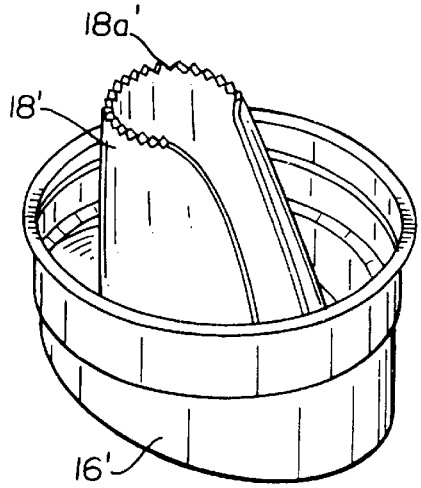
FIG. 7 is a detailed perspective view of the bottle opening and spout shown in FIG. 6 unassembled from the mouth of the bottle.

Another embodiment of a neck opening insert 16' including a modified spout 18' is shown in FIGS. 6 and 7. In this embodiment, the spout 18' is provided with teeth 18*a*' to facilitate opening a reservoir in the cap to be explained hereinbelow.

Figure 8:
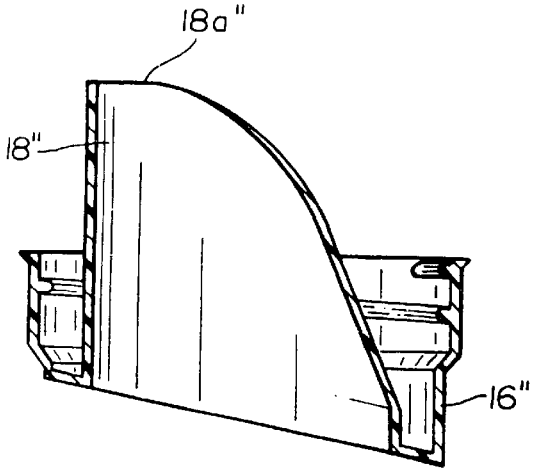
FIG. 8 is a vertical center cross-sectional view of another embodiment of a bottle opening and spout of the rechargeable dispenser according to the present invention shown unassembled from the neck of the bottle.
Figure 9:
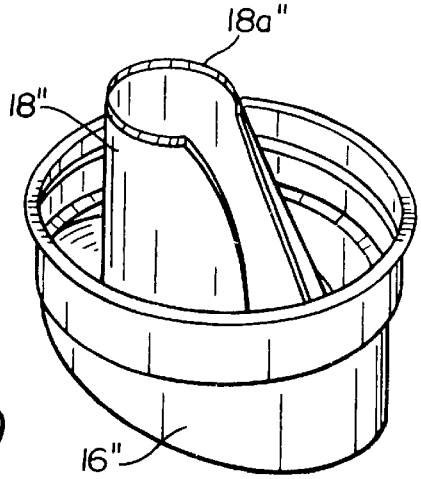
FIG. 9 is a perspective view of the bottle opening and spout shown in FIG. 8.

A further embodiment of the neck opening insert 16" is shown in FIGS. 8 and 9. In this embodiment, the spout 18" is provided with a sharpened cutting edge 18*a*" to facilitate opening of the reservoir in the cap to be discussed hereinbelow.

Figure 16:
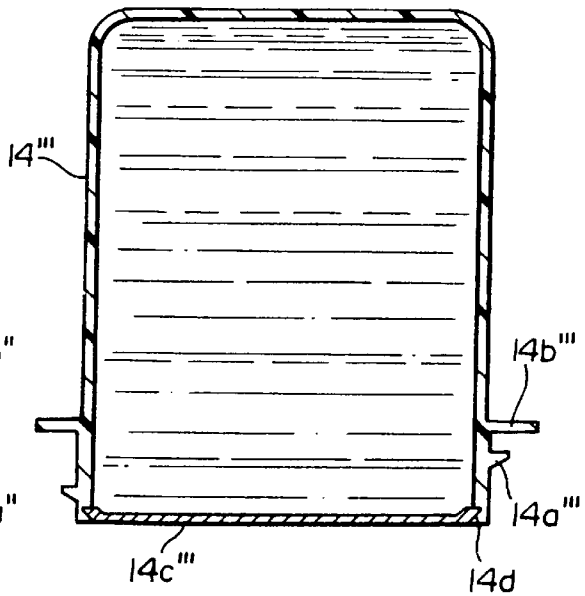
FIG. 16 is a vertical center cross-sectional view of an even further embodiment of the cap for use with the rechargeable dispenser according to the present invention.
Figure 15:
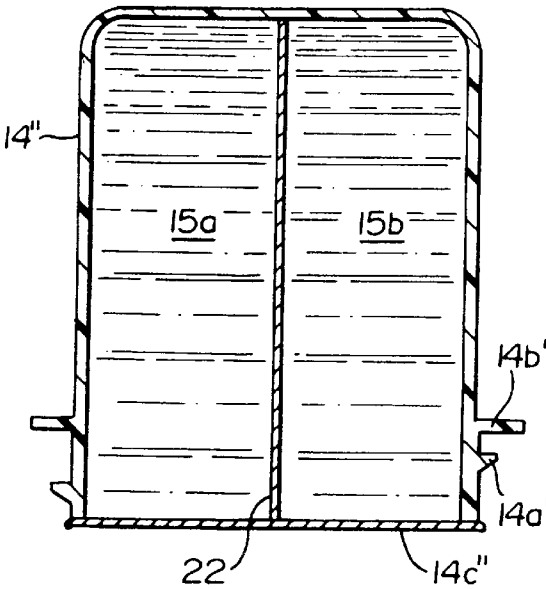
FIG. 15 is a vertical center cross-sectional view of the cap shown in FIG. 14.
Figure 14:
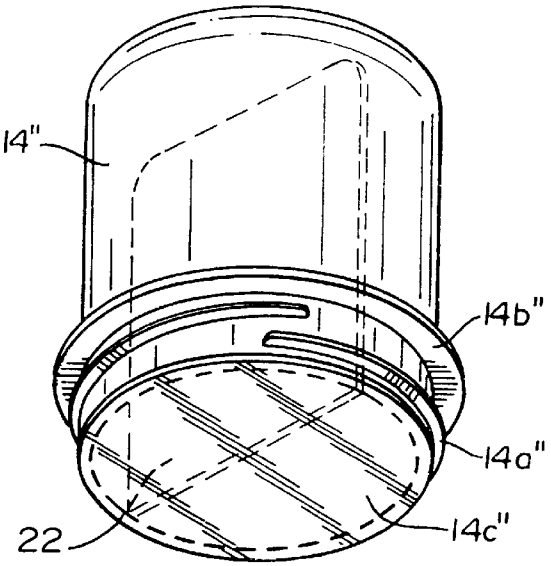
FIG. 14 is a perspective view of a further embodiment of a cap for use with the rechargeable dispenser according to the present invention.

The details of the cap 14 are shown in FIGS. 10 and 11. The cap 14 is provided with external threads 14*a* and a sealing flange 14*b*. The bottom of the cap is provided with a sealing membrane 14*c* defining a reservoir 15' containing concentrated chemical 20. The sealing membrane 14*c* can be metal foil, plastic sheet, composite or other suitable sealing membranes to hermetically seal the reservoir 15. The sealing membrane 14*c* must be designed to withstand the various chemical compounds to be stored within the reservoir 15 to provide a satisfactory shelf life. An alternative embodiment of the cap 14' as shown in FIGS. 12 and 13. In this embodiment, the membrane 14*c*' is sealed around the perimeter at a position above the lower edge of the cap 14. This embodiment allows a cap to be partially placed over the spout 18 prior to being opened by the spout 18 upon connecting the cap 14' to the bottle 12. In further embodiments, the membrane 14*c*' can be located even higher so that the external threads 14*a*' have already engaged with the internal threads of the neck opening insert 16 prior to comprising the sealing membrane 14*c*. In this manner, it is difficult or impossible to spill any of the chemical concentrate on the outside of the rechargeable dispenser. A multiple reservoir cap 14" is shown in FIGS. 14 and 15. In this embodiment, the cap 14 is provided with a partition wall 22 defining two separate reservoirs 15*a* and 15*b*. The two reservoirs 15*a* and 15*b* are hermetically sealed by the sealing membrane 14*c*". The reservoirs 15*a* and 15*b* may contain separate charges of the same chemical concentrate, or alternatively, two different components of a multi-component chemical system to be mixed with a diluent such as water within the bottle 12. When using this particular cap 14", it is preferred that the spout 18 is configured to rotate within the neck of the bottle 12 so that the spout can be selectively utilized for compromising one reservoir at a time to provide multiple recharging of the rechargeable dispenser. Alternatively, the spout can be provided with a slit down the center thereof so that the spout can compromise both reservoirs simultaneously for a multi-component chemical system. The sealing membrane 14*c*" seals around the entire lower perimeter of the cap 14" and with the bottom edge of the partition wall 22 to hermetically seal both reservoirs 15*a* and 15*b*. In a further embodiment shown in FIGS. 16, an inner flange 14*d* is provided to seal with the sealing membrane 14*c*'" so that the sealing membrane 14*c*'" is flush with the lower edges of the cap 14'". This embodiment would tend to prevent inadvertent rupturing or damage to the lower sealing membrane 14*c'"*.

The cap can be provided with a single reservoir or multiple separate reservoirs. The reservoirs can be positioned side-by-side and/or stacked one on top of each other to provide selective opening of the reservoirs and/or multiple opening of different reservoirs. One and two chamber reservoirs are shown in the embodiments, however, three, four, five, six, seven, eight, nine, ten or more reservoirs could potentially be provided in either a side-by-side and/or stacked arrangement within the cap. These multiple reservoir embodiments of the cap can provide a multiple number of times for recharging the rechargeable dispenser and/or multiple recharging with plural separate components. chemical concentrate to be stored within the one or more reservoirs can cover a wide range including household cleaners, commercial cleaners, glass cleaners, all-purpose cleaners, detergents, laundry detergent, dishwasher detergent, fabric softener, fabric protectant, carpet cleaner, fragrance, sanitizer, deodorizer, disinfectant, shower cleaning chemical (e.g. Clean Shower), oils, waxes, floor cleaning products, floor care chemicals, fungicides, insecticides, mildew treatments, and other types of chemical products.

The cap 14 shown in FIG. 10 defines the chemical reservoir 15. Alternatively, a separate cartridge 24 can be inserted within the cap 14, as shown in the embodiment of FIGS. 17 and 18. The cartridge 24 is preferably removably inserted within the cap 14 so that the cartridge 24 can be replaced after each use while reusing the cap 14. The cartridge 24 is provided with an outwardly extending lower flange 24*a* which abuts the lower edge of the cap 14 shown in FIG. 18 when the cartridge 24 is fully inserted within the cap 14. The cartridge 24 can be fixedly held within the cap 14 so as to not rotate relative thereto, or alternatively, the cartridge 24 can be rotated relative to the cap 14 when the cartridge 24 is fully inserted within the cap 14. This feature is important when the cap 14 is provided with multiple reservoirs so that the spout 18 does not need to rotate relative to the bottle 12, but instead the cartridge 24 can freely rotate within the cap 14 when twisting the cap 14 onto the bottle 12. A further embodiment using a cartridge system is shown in FIGS. 19 and 20. In this embodiment, a shorter length cartridge 24' is provided within the cap 14'. The cap 14' is provided with an inner flange 14*c*' to engage with the outwardly extending flange 24*a*' of the cartridge 14', shown in FIG. 20.

Chemical Products

In order to practically implement the rechargeable dispenser according to the present invention, it is important that the resulting ready-to-use mixed product is at least as effective and similar in consistency with conventional ready-to-use products sold today. In order to provide a ready-to-use product having a similar consistency with conventional ready-to-use products premixed at the factory, it was decided that a thickening process would need to be implemented when mixing the concentrated chemical with a diluent such as water within the rechargeable dispenser according to the present invention. In general, to make a solution more viscous one either adds a very thick syrup which is diluted or a two-part solution which thickens when mixed. In the present invention, a free flowing one-shot is utilized that is even less viscous then the diluted solution. The one-shot is stable as a one-part solution.

In the present invention, Acusol 820 (Rohm-Haas) is stabilized by 2butoxyethanol or isopropanol. If Acusol is added to water the solution thickens. However, if the Acusol is first mixed with one of the alcohols it is stable in the presence of water. This discovery allows one to use a one-part instead of a two-part system (such as encapsulation of the Acusol).

A 100 g one shot solution was prepared, which was diluted in a standard 100 ounce TIDE (PROCTOR AND GAMBLE) bottle. The conventional cap on the existing type bottle is large enough to hold about 200 grams, which is capable of providing two separate charges of chemical concentrated product.

EXAMPLE 1

Part A 55 g 625 FE (Henkel-Polyglycoside-nonionic surfactant as detergent)

5.5 g SXS (Stepan-Sodium Xylene Sulfonate-Hydrotrope solubilizer)

35 g Ninol 40-CO (Stepan-Coco Diethanolamide-nonionic surfactant)

10 g Salts (Anti-corrosive solution of 72 g Water, 7 g EDTA, 29 g Sodium Metasilicate)

5 g Standapol A (Ammonium Lauryl Sulfate-anionic surfactant)

5 g Ammonium Hydroxide (28% solution to adjust PH—Acusol thickens in final solution as a function of PH)

Part B 4.5 g Acusol 820 (acrylic polymer thickener)

6 g 2Butoxyethanol

Part C

Ammonium Hydroxide 28% Solution

Part D 0.6 g Violet Dye (Pylam Products)

0.4 g Cherry Red Dye (Pylam Products)

One Shot Solution 37 g A, 57 B, 8 g C, 6 g D 25 g of one shot solution was added to 750 ml of water. The resulting liquid laundry detergent appeared to clean oily stains better than TIDE. However, TIDE cleaned soil stains better than this one shot.

We have been able to improve this formula by significantly reducing the amount of Acusol (Part B), and converting the weight saving entirely to cleaning surfactants while maintaining a viscous solution.

EXAMPLE 2

Part A 15 g 1625FE 8.5 g SXS

One Shot Solution 37 g A, 47 g A2, 10 g B, 8 g C, 6 g D 25 g of one shot solution was added to 750 ml of water. The resulting liquid laundry detergent appeared to clean oily and soil stains better than TIDE. TIDE had a slightly whiter background.

EXAMPLE 3

Part E

Optical brightener (Ciba Geigy)

One Shot Solution 37 g A, 47 g A2, 10 g B, 8 g C, 6 g D, 2 g E 25 g of one shot solution was added to 750 ml of water. The resulting liquid laundry detergent appeared to clean oily and soil stains better than TIDE. The background was as white as TIDE.

EXAMPLE 4

Part A3

Standapol ES-2 (Henkle-Sodium Laureth 2-Sulfate-anionic surfactant)

One Shot Solution 37 g A, 47 g A3, 10 g B, 8 g C, 6 g D 25 g of one shot solution was added to 750 ml of water. The resulting liquid laundry detergent appeared to clean oily and soil stains better than TIDE.

We have also formulated dishwashing liquids using similar formulas. To achieve a heavier body and more viscous solution, we increased the ratio of Parts B and C, to Parts A and D. We could vary the viscosity from a thick pouring liquid (e.g. DAWN) to a gel (e.g. JELLO).

Operation

The rechargeable dispenser according to the present invention is preferably operated as follows. The bottle 12 of the rechargeable dispenser 10 is filled with a diluent such as water. An optional fill line can be molded into the bottle 12 to show the proper fill level for the diluent. A cap 14 containing chemical concentrate is positioned over the spout 18, and then pressed downwardly so that the upper edge of the spout 18 engages with the sealing membrane 14*c*. The cap 14 is further pressed down so that upper edge of the spout 18 cuts through the sealing membrane 14*c* allowing the chemical concentrate to drain from the cap 14 into the bottle 12 and then mixed with the diluent contained therein. The cap 14 is tightened onto the bottle 12, and then the container is shaken to agitate the mixture to provide complete mixing thereof After mixing, the rechargeable dispenser contains a full charge of ready-to-use chemical product to then be dispensed from the rechargeable dispenser by removing the cap 14 and then pouring chemical product from the spout 18 by tipping the bottle 12 using the handle 12*a*.

The multiple reservoir cap 14" shown in FIGS. 14 and 15 can be utilized by positioning one of the reservoirs 15*a* or 15*b* over the spout 18. It is noted that the spout 18 shown in FIG. 4 would need to be modified so as to be only half the width shown to be utilized with the two reservoir cap 14" shown in FIG. 15. One of the reservoirs 15*a* or 15*b* is then forced downwardly so that the modified spout 18 punctures the sealing membrane 14*c*" of that particular reservoir to release one charge of chemical concentrate into the bottle. This procedure makes one entire rechargeable dispenser of ready-to-use product. After complete usage of the chemical product, the cap 14" is removed and diluent such as water is added to the bottle 12 and then the remaining reservoir is compromised to provide a second charge of chemical concentrate to rechargeable dispenser to form a second batch of ready-to-use product. Thus, the cap 14" can provide two full recharges of the rechargeable dispenser.

Figure 21:
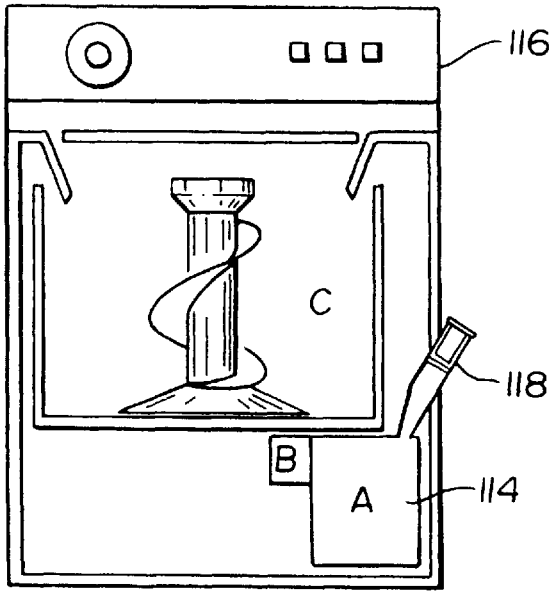
FIG. 21 shows a partial cross-sectional view of a washing machine including an alternative embodiment of a rechargeable dispensing apparatus according to the present invention.

FIG. 21 shows an alternative embodiment of a rechargeable dispensing apparatus 140 according to the present invention. As shown schematically in FIG. 21, rechargeable dispensing apparatus 114 includes a detergent tank, A, in fluid communication with a wash bin, C, of a washing machine 116. Mounted peripherally of detergent tank 114 is a pump, B, for introducing detergent held in tank, A, to wash bin, C. Preferably, washing machine 116 is configured to control the operation of pump, B, as a function of the wash cycle selected by the user of machine 116. The portion of detergent introduced to wash bin, C, may thereby be accurately controlled, i.e. no user portioning of detergent.

Figure 22:
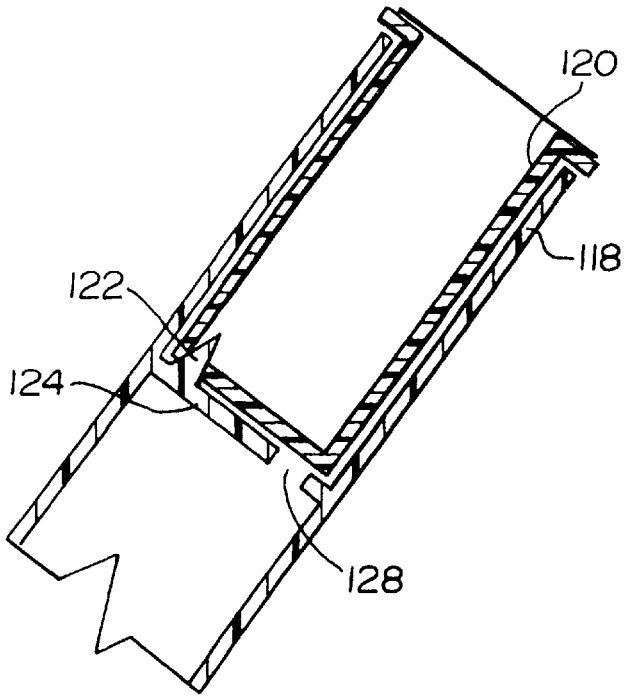
FIG. 22 shows a partial cross-sectional view of the fill tube of the rechargeable dispensing apparatus shown in FIG. 21.

Preferably detergent tank, A, includes a fill tube 118 which is configured to releasably receive a cartridge 120 filled with a chemically concentrated detergent as shown in FIG. 22. In the preferred embodiment shown in FIGS. 21 and 22, a piercing element 122 is included on a stop wall 124 in fill tube 118. Thus, when concentrate cartridge 120 is inserted into fill tube 118, piercing element 122 pierces the floor 126 of cartridge 120 and allows the concentrate therein to be released into fill tube 118. Specifically, the detergent concentrate flows through a hole 128 in floor 124 and into detergent tank, A. Cartridge 120 may then be removed and a diluent, specifically water, may, be introduced in the proper quantity through fill tube 118 to tank, A, to dilute the detergent concentrate in the tank, A. Alternatively, washing machine 116 may be configured to automatically charge tank, A, with water upon receipt of a cartridge in fill tube 118.

A further alternative embodiment of a rechargeable dispensing apparatus 142 is shown in FIGS. 23–26. Preferably, rechargeable dispensing apparatus 142 includes a cage portion 128 which is mounted to an agitator 130 within a wash bin, C, of a washing machine 116. Cage portion 128 is therefore in fluid communication with wash bin, C, of washing machine 116. As shown in FIG. 24 cage portion 128 is configured to receive an alternative embodiment of a cartridge 132 according to the present invention. Preferably, cartridge 132 includes at least one chemical reservoir. In the embodiment shown in FIGS. 24–26, cartridge 132 includes a first reservoir 134 containing detergent and a second reservoir 136 including a secondary chemical such as a rinsing agent or a fabric softener. It is important to note that cartridge 132 includes a flange 140 having a flat side 142 which allows cartridge to be loaded into cage portion 128 in only one orientation as shown in FIGS. 24–25. As shown in FIGS. 24–26, reservoir 134 is configured to be compromised by a piercing element 138 included in a floor 141 of cage portion 128 Reservoir 136 is specifically configured to compromise under the centrifugal force generated by agitator 142 during a spin cycle of washing machine 116. Specifically, a hole 150 is covered by a foil 152 which tears under significant centrifugal force thereby allowing the secondary chemical within reservoir 136 to be released out of hole 146 in floor 141 of cage portion 128. It is important to note that cage portion is specifically angled outwardly to ensure that the force vector associated with spinning agitator 130 acts significantly upon foil 152.

What is claimed is:

1. A rechargeable dispensing apparatus, comprising:

a bottle provided with a neck portion including an opening;

a cap removably connected to said neck portion of said bottle, said cap provided with at least one reservoir containing concentrated product, said cap configured for storing said concentrate product;

a pouring spout connected to and disposed within said neck portion of said bottle, said pouring spout configured for selectively accessing said at least one reservoir in said cap for releasing said concentrated product into said bottle to be mixed with a diluent, said pouring spout configured to be covered by said cap when said cap is connected to said bottle and configured to facilitate pouring contents from said bottle when said cap is removed from said bottle.

2. The apparatus according to claim 1, wherein said cap is provided with multiple reservoirs.

3. The apparatus according to claim 1, wherein said reservoir is provided within a cartridge, said cartridge configured to connect with the rechargeable dispensing apparatus.

4. The apparatus according to claim 3, wherein said cartridge is configured with multiple reservoirs to allow selective opening of each reservoir to allow multiple recharging of the rechargeable dispensing apparatus.

5. The apparatus according to claim 4, wherein said spout is configured to rotate within said opening of said bottle.

6. The apparatus according to claim 3, wherein said cartridge is configured with multiple reservoirs to allow selective opening of plural reservoirs to allow mixing of multiple components within said rechargeable dispensing apparatus.

7. The apparatus according to claim 3, wherein said spout is configured to open said cartridge.

8. The apparatus according to claim 1, wherein said reservoir is provided with a cartridge, said cartridge configured to connect with said cap.

9. The apparatus according to claim 8, wherein said cartridge is removably connected to said cap.

10. The apparatus according to claim 8, wherein said cartridge is configured with multiple reservoirs to allow selective opening of each reservoir to allow multiple recharging of the rechargeable dispensing apparatus.

11. The apparatus according to claim 10, wherein said spout is configured to rotate within said opening of said bottle.

12. The apparatus according to claim 8, wherein said cartridge is configured with multiple reservoirs to allow selective opening of plural reservoirs to allow mixing of multiple components within said rechargeable dispensing apparatus.

13. The apparatus according to claim 1, wherein said spout is configured to open said reservoir.

14. The apparatus according to claim 1, wherein said spout is provided by a bottle opening insert including a spout, said bottle opening insert configured to connect with said opening of said bottle.

15. The apparatus according to claim 1, said spout configured for opening said reservoir.

16. The apparatus according to claim 15, wherein said spout is provided with teeth for opening said reservoir.

17. The apparatus according to claim 15, wherein said spout is provided with a sharpened surface for opening said reservoir.

18. A laundry detergent dispensing apparatus, comprising:

a bottle;

a cap removably connected to said bottle;

a pouring spout extending upwardly from said bottle, said pouring spout configured to be enclosed by said cap when said cap is connected to said bottle and configured to facilitate pouring contents from said bottle when said cap is removed from said bottle; and a reservoir containing concentrated laundry detergent configured to connect to the laundry detergent dispensing apparatus, said reservoir is provided within said cap, said spout configured to open said reservoir.

19. The apparatus according to claim 18, wherein said concentrated laundry detergent is formulated to increase the viscosity of diluent when mixed together within the laundry detergent mixing apparatus.

20. The apparatus according to claim 19, wherein said concentrated laundry detergent contains Acusol.

21. The apparatus according to claim 20, wherein said concentrated laundry detergent contains Acusol stabilized by 2butoxyethanol or isopropanol.

* * * * *